US005443216A

United States Patent [19]

Lajoie

[11] Patent Number: 5,443,216

[45] Date of Patent: Aug. 22, 1995

[54] HAMMER MILL

[76] Inventor: Donald L. Lajoie, 18 Senga Rd., South Norwalk, Conn. 06854

[21] Appl. No.: 304,151

[22] Filed: Sep. 12, 1994

[51] Int. Cl.[6] ..... B02C 13/04

[52] U.S. Cl. ..... 241/194; 241/196

[58] Field of Search ..... 241/194, 195, 196

[56] References Cited

U.S. PATENT DOCUMENTS

| | | | |
|---|---|---|---|
| 1,793,097 | 2/1931 | Kramer | 241/195 |
| 2,822,138 | 2/1958 | Olive | 241/194 |
| 3,934,826 | 1/1976 | Graveman | 241/81 |
| 4,149,677 | 4/1979 | Graveman et al. | 241/196 X |
| 4,917,314 | 4/1990 | Manschwetus | 241/194 |
| 5,002,233 | 3/1991 | Williams | 241/195 X |
| 5,392,999 | 2/1995 | Konig et al. | 241/194 |

FOREIGN PATENT DOCUMENTS

| | | | |
|---|---|---|---|
| 369997 | 4/1939 | Italy | 241/196 |

*Primary Examiner*—Mark Rosenbaum
*Assistant Examiner*—John M. Husar
*Attorney, Agent, or Firm*—Edward R. Hyde

[57] ABSTRACT

A mill for shredding objects by rotating hammers. Each hammer has two heads and is mounted to rotate on its central axis. Thus both heads are operative for shredding without stopping the machine.

10 Claims, 2 Drawing Sheets

HAMMER MILL

BACKGROUND OF THE INVENTION

1. Field of the Invention

This invention relates to hammer mills and in particular to heavy duty mills of the type employed to break up discarded automobile bodies. Hammer mills or shredders of this type are large enough to receive an entire automobile body and of sufficent power to reduce it to fragments or pieces for subsequent separation into various categories of materials to be recycled.

2. Description of the Prior Art

Hammer mills of the type herein described conventionally include a rotor which serves to mount a series of pivoting hammers. The automobile bodies or other items to be shredded are conveyed to the vicinity of the rotor and the impact of the pivoting hammers on the items results in shredding them. Because of the nature of the items being shredded, the hammers after a time will wear and become less effective in the shredding operation. In many prior art systems of this type the hammer must then be replaced which can be a time consuming operation considering the mass and weight of the hammer units. In some prior art systems, there is provided double headed hammers so that when one head wears the hammer is reversed and remounted to bring the other head into operation. In order to do this, it is necessary to shutdown the hammer mill so that the hammers can be dismounted and remounted with the opposite head in operative position.

Examples of hammer mills of the general type in which the present invention is used are disclosed in U.S. Pat. Nos. 1,041,495 and 3,727,848. Further, a double headed hammer of the type found in the prior art is disclosed in U.S. Pat. No. 5,002,233.

A basic disadvantage of prior art systems in which double headed hammers are used is that the mill must be shut down in order for the hammers to be remounted with their unworn heads in operative position. The downtime, of course, results in the expense of a major machine being nonused for substantial periods. It is to this general problem that the present invention is directed.

SUMMARY OF THE INVENTION

A primary object of the present invention is to provide a hammer mill in which there is a series of double headed hammers which are brought into operation without shutting down the hammer mill.

Another object of the present invention is to provide a hammer mill having double headed hammers in which the heads are brought into shredding operation without remounting of the hammers.

A further object of the present invention is to provide an improved type of hammer having two heads in which both are brought into shredding operation during continous operation of the machine.

The above objects of the invention are achieved by providing a hammer having two heads and in which the hammer is mounted to pivot on its central axis with the two heads being available for shredding during operation of the machine. Thus as a hammer head is worn, centrifugal force will bring the other less worn head into operative position. Further, during normal operation of the hammer mill both heads of the hammer, because of the central mounting, will serve to shred the items.

BRIEF DESCRIPTION OF THE DRAWINGS

The foregoing and still other objects and advantages of the present invention will be more apparent from the following detailed explanation of the preferred embodiments of the invention considered in connection with the accompanying drawings herein which:

FIG. 3 is a perspective view of a hammer of the present invention; an

DESCRIPTION OF A SPECIFIC EMBODIMENT

Figure 1:
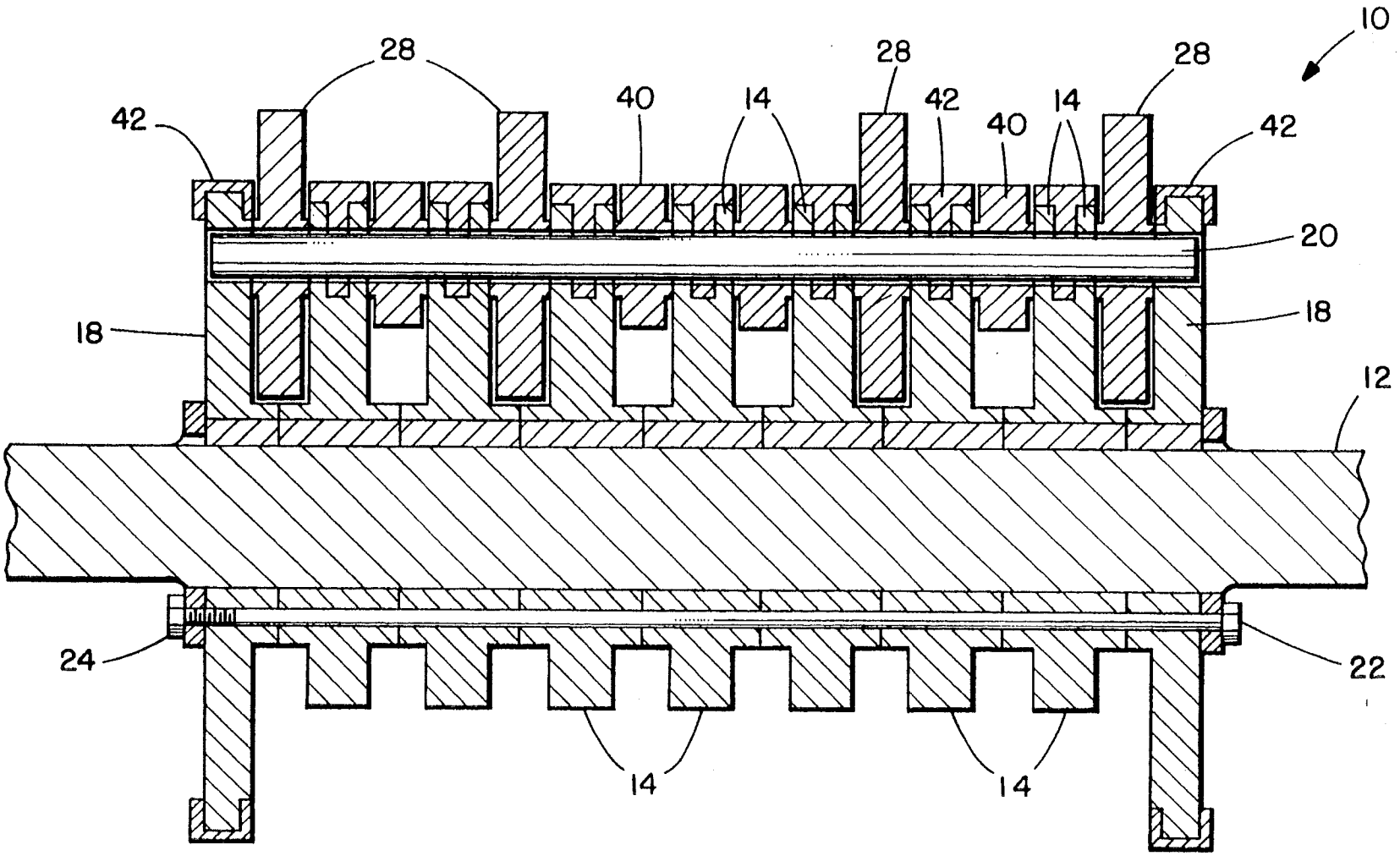
FIG. 1 is a cross section of a hammer mill rotor assembly of the present invention taken on the line I—I of FIG. 2.

For purposes of understanding the general type of environment for the present invention there is shown a hammer mill in U.S. Pat. No. 3,727,848 which has pivotally mounted hammers mounted in a rotor assembly for breaking up discarded automobile bodies. The present invention relating to an improved rotor assembly is described in connection with a hammer mill of that general type. However, it should be understood that the invention herein disclosed could be used in other types of rotary chopping devices and is not limited to a hammer mill for chopping automobiles.

Referring now to the drawings, numeral 10 designates a rotor assembly having a rotor shaft 12 which is mounted in the hammer mill for rotation by any suitable hammer mill mechanism (not shown). Mounted on the shaft 12 is a series of plates 14 each of which has a series of radial arms 16 which are a part of and integral with the plate. In the embodiment shown there are 6 radial arms extending from the center portion of each plate 14. Also mounted on shaft 12 are end plates 18 which may be similar to the intermediate plates 14.

Each of the radial arms 16 of plates 14 and end plates 18 has an opening or bore passing therethrough. The bores of corresponding radial arms are aligned and a rod 20 passes through the aligned bores as shown in FIGS. 1 and 2.

Figure 2:
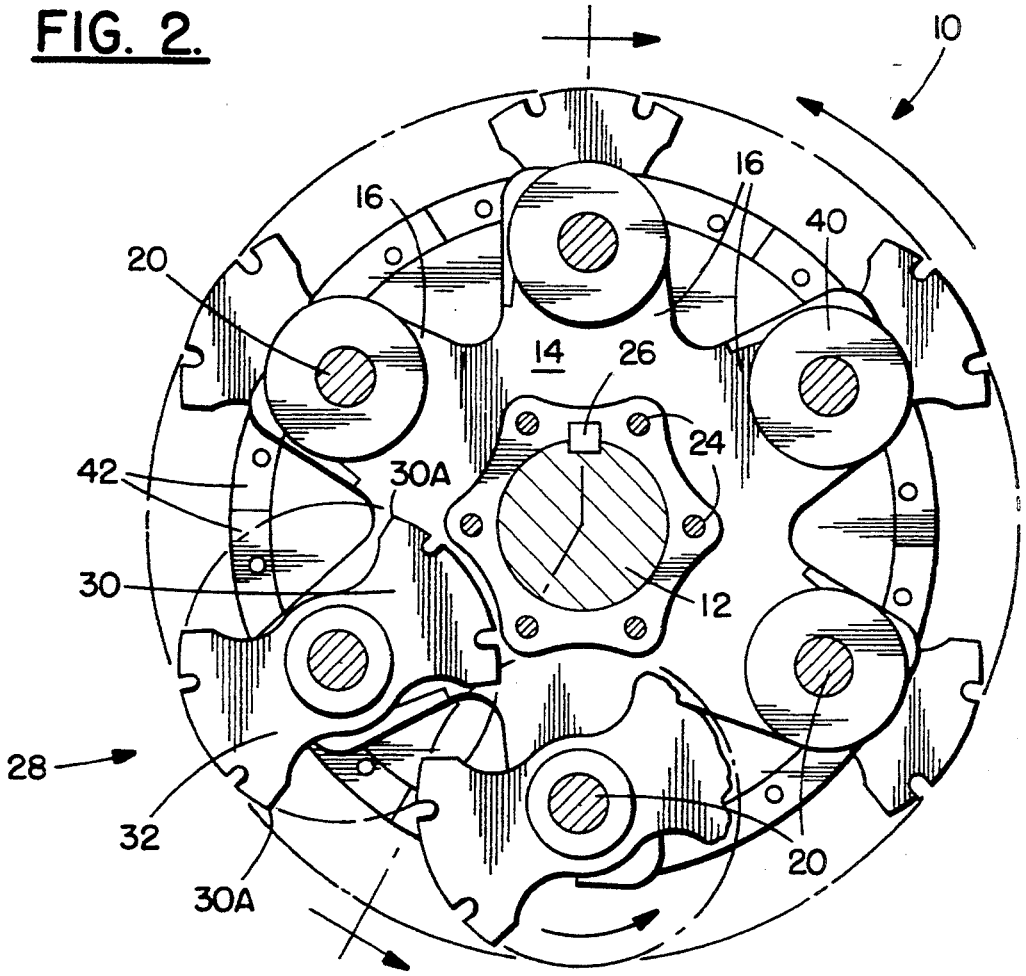
FIG. 2 is an end view of the rotor assembly of FIG. 1.

The central or hub portion of each plate 14 and end plates 18 have holes passing therethrough to receive tie rods 22 as more clearly seen in FIG. 1.

One end of each tie rod is screw threaded to receive nut 24. The six tie rods serve to hold the series of plates together in a unitary structure. A key 26 inserted in a slot shaft 12 and in corresponding slots in the plates joins the shaft to the plates so that rotation of the shaft will result in corresponding rotation of plates 14 and end plates. 18.

Figure 3:
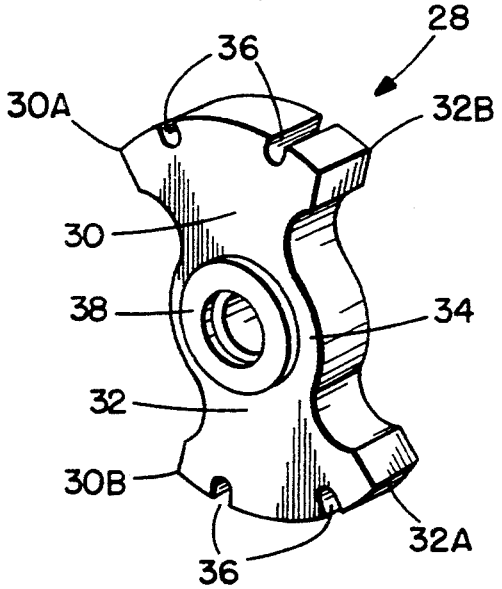
Figure 4A:
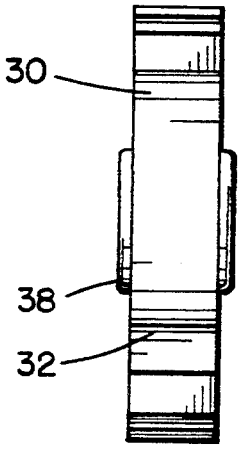
FIGS. 4A and 4B are side views of two embodiments of the hammer of the present invention.

Located between certain adjacent plates are hammers 28 which impact the items to be chopped in the mill. FIG. 3 shows a hammer comprising two heads 30, 32 and a central hub portion 34. It is seen that the hammer heads 30 and 32 are of similar shape and form. A bore passes through the center of each hammer so that it may be rotatably mounted on the rods 20. Grooves 36 are cut in the outer edges of each hammer head to assist in breaking the items that are being chopped in the mill. The central bore has a boss 38 as shown in FIG. 3 and 4A. The hubs will bear against the associated plates of each hammer as more clearly seen in FIG. 1.

It is understood then that the entire rotor assembly 10 will rotate in the hammer mill with rotating shaft 12. The hammers 28 are free to rotate about rods 20 and as the assembly rotates the hammer heads 30, 32 will impact the objects to be shredded. A particular impact will cause the hammer to rotate which it is free to do. In FIG. 2 the assembly is shown to rotate in a counterclockwise direction in which case the sharp leading edges of each hammer will impact the items to be shredded. Thus cutting edge 32A will effect the shredding operation. As the shredding operation continues, edge 32A and the outer area of head 32 will wear and become of lighter weight. As a result centrifugal force will cause the other head 30 of hammer 28 to extend outward in which position cutting edge 30A will be brought into cutting position. Thus it is seen that the rotatably mounted hammer 28 having two heads 30, 32 will automatically bring the second head into shredding operation upon the wearing of the first head. After the cutting edges 32A and 30A of the two heads are worn the hammer may be reversed on the rotor shaft 12 to then bring cutting edges 30B and 32B into operative position.

Certain of the adjacent plates 14 may have spacers 40 rather than hammers 28. The spacers are of donut shape and mounted on rods 20 similarly to the hammers 28. In order to protect the outer edge of plates 14 there are a series of T-shaped caps 42 that are received in grooves on the outer edges of plates 14. Similarly the end plates are protected with U-shaped caps 42.

It should be understood that one particuarly important novel feature of the invention is that the hammers have double heads and are centrally mounted. Further, the pair of heads on each hammer are similar and congruant as seen in FIG. 3. Each hammer is symetrical with both the longitude axis passing through its center and with respect to the horizontal axis thereof. Thus, distinction to prior art hammer mill hammers, the present invention provides two heads that are automatically brought into operative position simply by operation of the hammer mill and there is no necessity to stop the mill and reverse a hammer when a head is worn. In the present invention the rotatable mounted hammer provides two heads that will impact the objects fed to the mill as the rotor rotates.

Figure 4B:
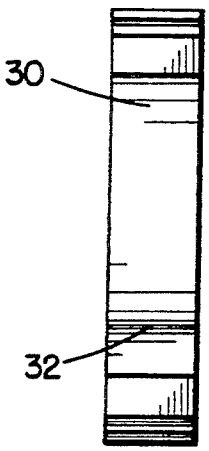

FIG. 4B shows a modification of the hammer 28 in which the boss 38 is eliminated. This permits a wider or thicker hammer throughout the entire rotor that in turn provides greater impacting service and results in a hammer mill rotor of increased efficiency.

Having thus described the invention with particular reference to the preferred forms thereof, it will be obvious that various changes and modifications may be made therein without departing from the spirit and scope of the invention as defined in the claims.

What is claimed is:

1. A hammer mill rotor assembly comprising:
a rotor drive shaft;
a plurality of parallel plates secured to said drive shaft;
each plate having a plurality of equally spaced radial arms;
each radial arm having a bore passing therethrough;
the bores of corresponding arms being aligned;
rod means passing through the aligned bores of corresponding radial arms;
hammer means located between a pair of adjacent radial arms at the outer ends thereof;
said hammer means comprising an elongated body having a central bore and a plurality of hammer heads;
each hammer head having an outer impact portion to engage objects to be shredded in the hammer mill;
said hammer means central bore being aligned with the bores of adjacent radial arms and having the rod means passing therethrough;
said rod means and said hammer head means central bores being concentric and of approximately the same diameter for smooth rotatable movement of the hammer head means.

2. The hammer mill rotor assembly set forth in claim 1 in which the number of hammer heads of each hammer means is two.

3. The hammer mill rotor of claim 2 in which the two hammer heads of each hammer means are congruant.

4. The hammer mill rotor of claim 2 in which the two hammer heads of each hammer means are symetrical with respect to said short axis of the elongated body.

5. A hammer mill rotor assembly comprising;
a plurality of plates each having a central bore;
a rotor drive shaft adapted to be rotatably mounted passing through the central bores of the plurality of plates;
each plate having a plurality of equally spaced radial arms;
each radial arm having a bore passing therethrough at the outer end thereof;
rod means passing through the aligned bores of corresponding radial arms;
a plurality of hammer means located between adjacent pairs of radial arms at the outer ends thereof;
each hammer means comprising an elongated body member having a central bore passing therethrough and defining a longitudinal axis and a lateral axis;
said elongated body hammer means having a pair of outer portions defining a pair of hammer heads;
the hammer means central bore being aligned with the bores of adjacent radial arms and having the rod means passing therethrough to rotatably mount the hammer means;
said rod means and hammer means bores being concentric for smooth rotatable movement of the hammer head means on said rod means; and
the pair of hammer heads of each hammer means being of a shape symetrical with respect to the said lateral axis thereof.

6. The rotor assembly of claim 5 in which the pair of hammer heads of each hammer means are of a shape symetrical with respect to the said longitudinal axis thereof.

7. A hammer mill assembly comprising:
a flat elongated hammer means having a central axis;
said hammer means having two outer end portions each of which comprises a hammer head;
the said central axis of the hammer means having a bore passing therethrough;
rod means passing through the said central bore to rotatably mount said hammer means whereby both said hammer heads may be operative upon rotation of said rod means;
the diameters of said hammer means bore and said rod being substantially equal to provide a smooth rotary fit.

8. The assembly defined in claim 7 in which the two hammer heads are congruant.

9. The assembly defined in claim 7 in which the two hammer heads are symetrical with respect to the short axis of the elongated member.

10. The assembly defined in claim 7 in which the hammer means bore and said rod are concentric.

* * * * *